US008701419B2

(12) United States Patent
Hughes

(10) Patent No.: US 8,701,419 B2
(45) Date of Patent: Apr. 22, 2014

(54) MULTI-TUBE FUEL NOZZLE WITH MIXING FEATURES

(75) Inventor: Michael John Hughes, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/468,961

(22) Filed: May 10, 2012

(65) Prior Publication Data

US 2013/0298561 A1 Nov. 14, 2013

(51) Int. Cl.
*F02C 1/00* (2006.01)

(52) U.S. Cl.
USPC ..... 60/772; 60/737; 60/740; 60/756

(58) Field of Classification Search
USPC ..... 60/737, 740, 746, 748, 756, 772
See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 4,357,991 | A | 11/1982 | Cameron | |
| 4,413,394 | A | 11/1983 | Small | |
| 4,722,181 | A * | 2/1988 | Yu | 60/776 |
| 5,213,494 | A | 5/1993 | Jeppesen | |
| 5,638,682 | A * | 6/1997 | Joshi et al. | 60/737 |
| 6,530,223 | B1 * | 3/2003 | Dodds et al. | 60/746 |
| 6,808,017 | B1 | 10/2004 | Kaellis | |
| 6,880,340 | B2 * | 4/2005 | Saitoh | 60/737 |
| 2009/0031728 | A1 * | 2/2009 | Miura et al. | 60/737 |
| 2010/0218501 | A1 * | 9/2010 | York et al. | 60/737 |
| 2012/0036856 | A1 | 2/2012 | Uhm et al. | |
| 2012/0079829 | A1 | 4/2012 | Berry et al. | |

FOREIGN PATENT DOCUMENTS

| | | | |
|---|---|---|---|
| EP | 2216599 | A2 | 8/2010 |
| EP | 2224172 | A2 | 9/2010 |
| EP | 2378202 | A2 | 10/2011 |

OTHER PUBLICATIONS

U.S. Appl. No. 13/277,516, filed Oct. 20, 2011, Chunyang Wu et al.
Jian Wen, Yanzhong Li, Aimin Zhou, Ke Zhang, "An experimental and numerical investigation of low patterns in the entrance of plate-fin heat exchanger," International Journal of Heat and Mass Transfer, Jan. 19, 2006, p. 1667, vol. 49.
Extended European Search Report for EP Application 13167264.4-1602 dated Aug. 20, 2013.

* cited by examiner

*Primary Examiner* — Gerald L Sung
*Assistant Examiner* — Scott Walthour
(74) *Attorney, Agent, or Firm* — Fletcher Yoder P.C.

(57) ABSTRACT

A system includes a multi-tube fuel nozzle having an inlet plate and a plurality of tubes adjacent the inlet plate. The inlet plate includes a plurality of apertures, and each aperture includes an inlet feature. Each tube of the plurality of tubes is coupled to an aperture of the plurality of apertures. The multi-tube fuel nozzle includes a differential configuration of inlet features among the plurality of tubes.

19 Claims, 8 Drawing Sheets

MULTI-TUBE FUEL NOZZLE WITH MIXING FEATURES

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND OF THE INVENTION

The subject matter disclosed herein relates to a combustion system and, more specifically, to a fuel nozzle with an improved design to increase fuel-air mixing within the fuel nozzle.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, e.g., an electrical generator. The gas turbine engine includes a fuel nozzle to inject fuel and air into a combustor. As can be appreciated, the fuel-air mixture significantly affects engine performance, fuel consumption, and emissions. Some fuel nozzles, such as multi-tube fuel nozzles, include a plurality of tubes configured to mix fuel and air. In such fuel nozzles, the length and diameter of the tubes affect the quality of mixing. Unfortunately, long tubes or small diameter tubes may increase costs, weight, and stress on the turbine engine.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-tube fuel nozzle having an inlet plate and a plurality of tubes adjacent the inlet plate. The inlet plate includes a plurality of apertures, and each aperture includes an inlet feature. Each tube of the plurality of tubes is coupled to an aperture of the plurality of apertures. The multi-tube fuel nozzle includes a differential configuration of inlet features among the plurality of tubes.

In a second embodiment, a system includes a multi-tube fuel nozzle having an inlet plate and a plurality of tubes adjacent the inlet plate. The inlet plate includes a plurality of apertures, and each aperture includes an inlet feature. Each tube of the plurality of tubes includes an axial end and a fuel inlet downstream from the axial end. The axial end is coupled to an aperture of the plurality of apertures and is configured to receive an airflow through the respective aperture. The fuel inlet is configured to receive a fuel, and the airflow is configured to mix with the fuel to form an air/fuel mixture. The multi-tube fuel nozzle includes a differential configuration of inlet features among the plurality of tubes that is configured to control an air/fuel mixture among the plurality of tubes.

In a third embodiment, a method includes receiving fuel into a plurality of tubes extending through a body of a multi-tube fuel nozzle and receiving air differentially into the plurality of tubes through an inlet plate. The inlet plate includes an inlet feature for each tube of the plurality of tubes. The inlet plate includes a differential configuration of inlet features among the plurality of tubes. The method also includes outputting an air/fuel mixture from the plurality of tubes.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
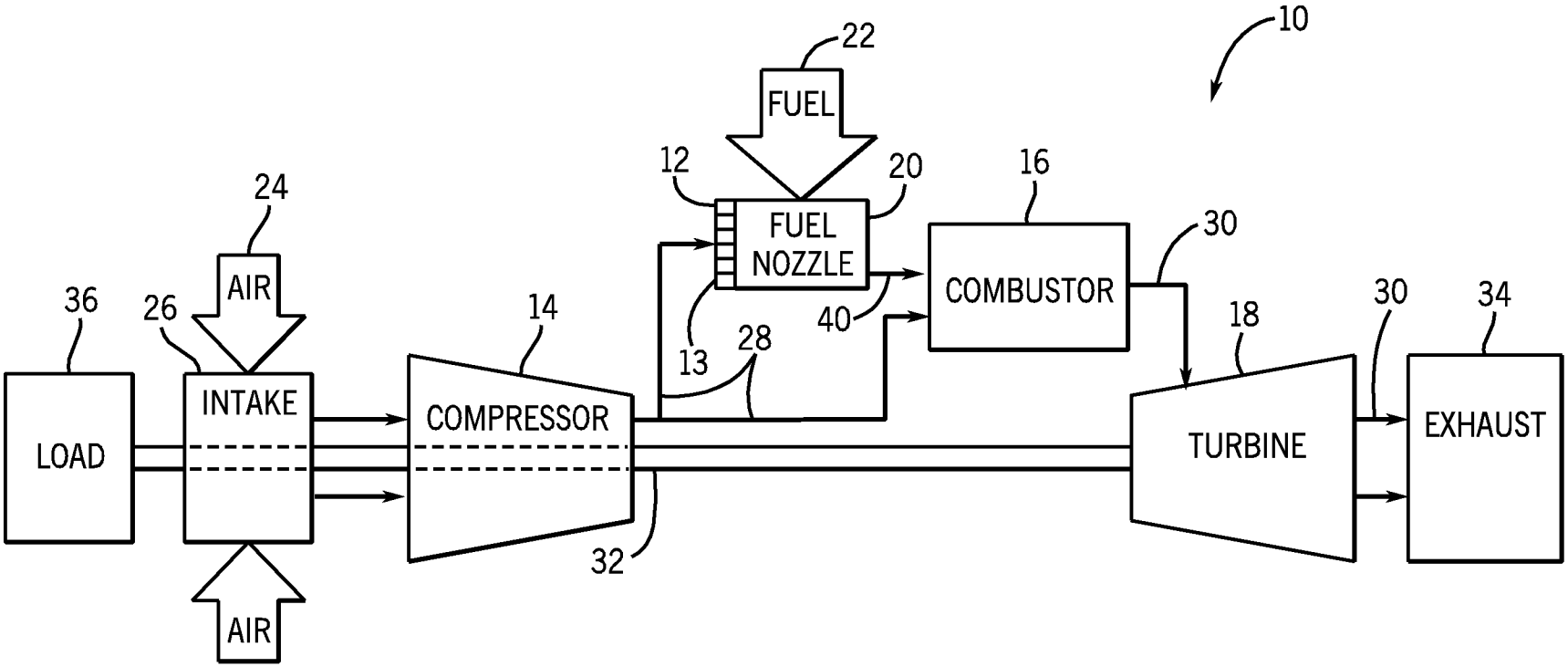
FIG. 1 is a block diagram of a turbine system including an embodiment of an inlet plate with mix-inducing features.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments include a multi-tube fuel nozzle with mix-inducing features configured to increase fuel-air mixing in each tube of the multi-tube fuel nozzle. A multi-tube fuel nozzles includes a plurality of parallel tubes (e.g., 10 to 1000 tubes), which receive both fuel and air that is internally mixed within the tubes before being injected into a combustor (e.g., a gas turbine combustor). The mix-inducing features may be disposed at any position along the length of each tube of the multi-tube fuel nozzle, and may be generally described as flow disruptors that create flow disturbances in the tube to promote fuel-air mixing. In the embodiments discussed below, the mix-inducing features are presented in context of an inlet of each tube of the multi-tube fuel nozzle, although the mix-inducing features may be disposed within any upstream portion (e.g., the first 0 to 50 percent of each tube length) of each tube of the multi-tube fuel nozzle. The mix-inducing features may include a variety of structures integral or separate from each tube, such as an inlet plate, a deformation of the tube, an added protrusion (e.g., tab, prong, or tooth), a wire, a surface texture, or any other structure that extends crosswise into the flow passage through the tube. For example, the mix-inducing features may include one or more inlet features that disrupt the flow at the inlet of each tube. The inlet features may be disposed on a mixing enhancement inlet plate (e.g., a common plate or other structure) that extends across all of the tubes, or each individual tube may have its own inlet features. For example, an inlet plate with apertures having inlet features coupled to an upstream axial end of each tube may affect the airflow entering each tube, and thus affecting the fuel-air mixture that exits the multi-tube fuel nozzle. As discussed below, each aperture of the inlet plate may have inlet features (e.g., projections, wedge shape, section shapes, linear projections) that may affect the airflow. The inlet features may produce swirl, form eddies, increase turbulence, or otherwise improve mixing of the airflow within each tube without changing the diameter and/or length of a tube. The airflow entering each tube may be different, leading to different qualities of fuel-air mixtures that exit each tube of the multi-tube fuel nozzle. Accordingly, differential configurations of inlet features among the tubes may affect the fuel-air mixture of the multi-tube fuel nozzle to obtain a desired fuel-air mixture in the combustor.

Turning now to the drawings, FIG. 1 illustrates a block diagram of an embodiment of a gas turbine system 10, which may include a mixing enhancement inlet plate 12 with at least one mix-inducing feature 13 in accordance with present embodiments. The system 10 includes a compressor 14 (e.g., one or more compressor stages), one or more turbine combustors 16, and a turbine 18 (e.g., one or more turbine stages). Each turbine combustor 16 includes one or more fuel nozzles 20 (e.g., multi-tube fuel nozzles with the inlet plate 12), which inject a mixture of a fuel 22 (e.g., liquid and/or gas fuel) and air 24 into the respective turbine combustor 16. The compressor 14 receives the air 24 through an intake 26 and directs compressed air 28 into the combustor 16 and the fuel nozzle 20. At least some of the compressed air 28 is mixed with fuel 22 in the fuel nozzle 20 to create a fuel-air mixture 40 for combustion in the combustor 16. As discussed in further detail below, the inlet plate 12 enhances the mixing of fuel 22 and air 24 within the fuel nozzle 20, e.g., within each tube of the multi-tube fuel nozzle 20, thereby producing a better fuel-air mixture 40 for combustion in the combustor 16. The combusted fuel-air mixture then forms hot pressurized exhaust gases 30 that pass through the turbine 18, thereby driving rotation of a turbine shaft 32 before exiting through the exhaust outlet 34. In turn, the turbine shaft 32 drives rotation of the compressor 14 and a load 36, such as an electrical generator.

As discussed in detail below, the fuel nozzle 20 may be a multi-tube fuel nozzle, which includes a plurality of generally parallel tubes (e.g., 10 to 1000 tubes) that receive and mix the fuel 22 and the air 24 within each tube. In certain embodiments, each fuel nozzle 20 may be a can-type nozzle (e.g., an annular exterior body) or a sector nozzle (e.g., wedge shape or truncated pie shape exterior body). Furthermore, each combustor 16 may include a plurality of peripheral fuel nozzles 20 arranged around a central fuel nozzle 20 (e.g., nozzle 21 of FIGS. 2-4). The disclosed embodiments enhance the fuel-air mixing that occurs within each tube of the multi-tube fuel nozzle 20 by adding mix-inducing features 13, such as inlet features at an upstream end portion of each tube. The embodiment of FIG. 1 includes the inlet plate 12, which includes mix-inducing features 13 (e.g., inlet features) for each of the tubes in the multi-tube fuel nozzle 20. Accordingly, the air 24 (e.g., compressed air 28) may flow through apertures with inlet features before entering each of the tubes, thereby disturbing the air flow entering the tubes. In turn, the flow disturbances improve the fuel-air mixing within each tube. In the disclosed embodiments, the inlet plate 12 is disposed directly at the upstream axial end of each tube in the multi-tube fuel nozzle 20, e.g., directly attached to or abutting the upstream axial ends. As a result of the improved fuel-air mixing in the tubes of the multi-tube fuel nozzle 20, the fuel nozzle 20 may provide a more controlled distribution (e.g., uniform or specific distribution profile) of fuel-air mixing among the plurality of tubes, thereby improving combustion efficiency and power output, reducing pollutant emissions, and reducing undesirable combustion dynamics in the combustor 16.

Figure 2:
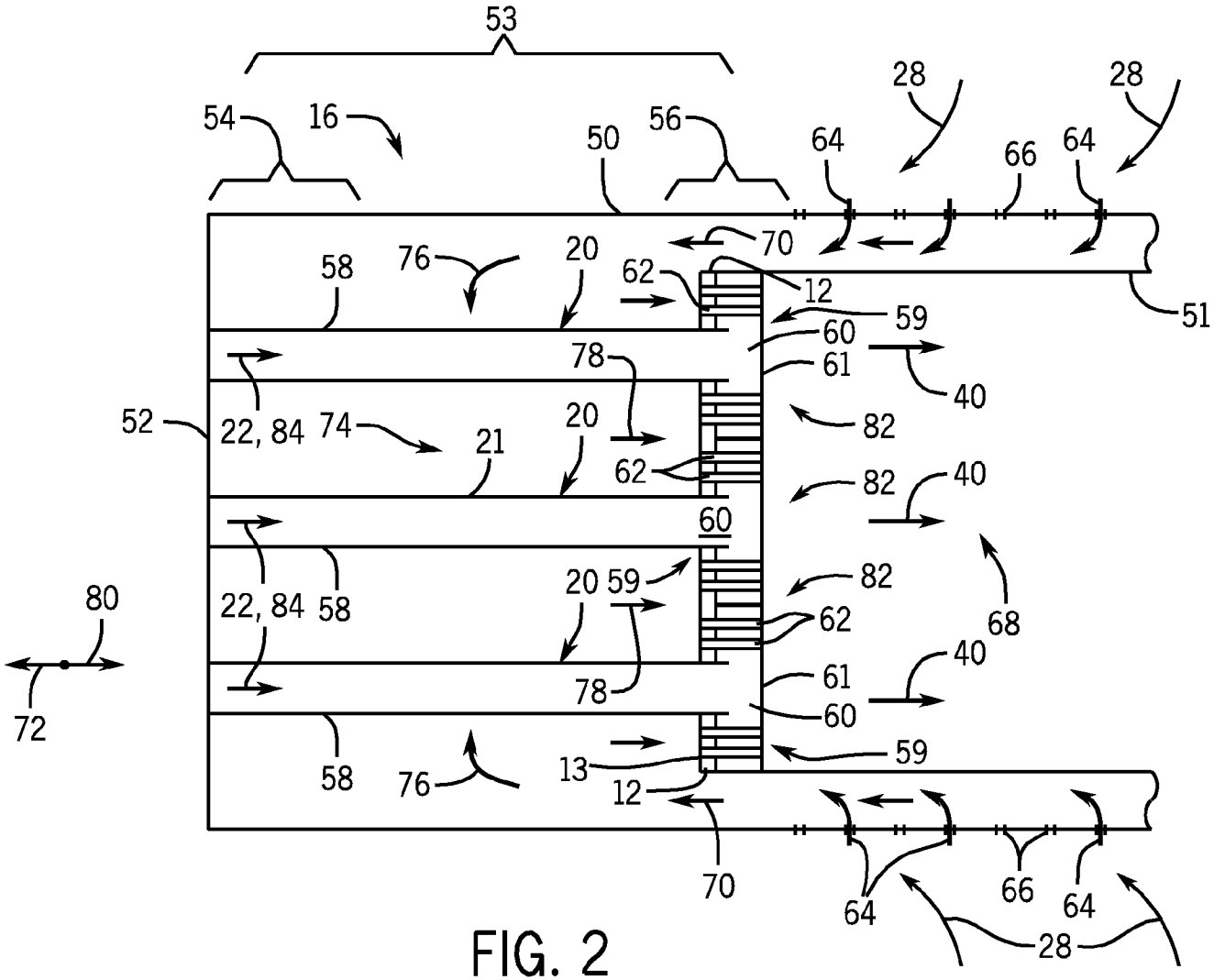
FIG. 2 is a cross-sectional side view of an embodiment of a combustor of FIG. 1 with a plurality of multi-tube fuel nozzles.

FIG. 2 is a cross-sectional side view of an embodiment of the combustor 16 of FIG. 1 with multiple fuel nozzles 20, each including an inlet plate 12 with mix-inducing features 13. The combustor 16 includes an outer casing or flow sleeve 50, a liner 51 disposed coaxially within the flow sleeve 50, an end cover 52, a head end 53, an upstream end portion 54 of the head end 53, and a downstream end portion 56 of the head end 53. Multiple fuel nozzles 20 (e.g., multi-tube fuel nozzles) are mounted within the combustor 16. Each fuel nozzle 20 includes a fuel conduit 58 extending from the upstream end portion 54 to the downstream end portion 56, and a fuel nozzle head 59 at the downstream end portion 56. The fuel nozzle head 59 includes a fuel chamber 60 that houses a plurality of tubes 62 (e.g., 10 to 1000 tubes), which include fuel inlets within the chamber 60 and air inlets outside of the chamber 60 along the inlet plate 12. In some embodiments, each fuel nozzle head 59 includes a nozzle wall 61 surrounding the fuel chamber 60. As noted above, the nozzle wall 61 of each fuel nozzle head 59 may define an annular shaped head, a wedge shape or truncated pie shape head, or any other geometrical shape. Regardless of the shape of the head 59, fuel 22 may enter the fuel conduit 58 from a source outside the combustor 16, and flow to the fuel chamber 60 within the fuel nozzle head 59. Once inside the head 59, the fuel enters the plurality of tubes 62 and mixes with an air flow passing through the tubes 62.

The compressed air 28 is also in fluid connection with the plurality of tubes 62 through the inlet plate 12. Compressed air 28 enters the combustor 16 through the flow sleeve 50, as generally indicated by arrows 64, via one or more air inlets 66. Compressed air 28 passing through the flow sleeve 50 helps cool the liner 51 to remove heat from combustion within a combustion chamber 68 surrounded by the liner 51. The compressed air 28 follows an upstream airflow path 70 in an axial direction 72 towards the end cover 52. The compressed air 28 then flows into an interior flow path 74, as generally indicated by arrows 76, and proceeds along a downstream airflow path 78 in the axial direction 80 through the inlet plate 12 into a tube bundle 82 (e.g., tubes 62) of each fuel nozzle 20.

In certain embodiments, the tube bundle 82 of each fuel nozzle 20 includes the plurality of tubes 62 in a generally parallel offset relationship to one another, wherein at least some or all of the tubes 62 are configured to mix the compressed air 28 and fuel 22 to create a fuel-air mixture 40 for injection into the combustion chamber 68. Fuel 22 flows in the axial direction 80 through each fuel conduit 58 along a fuel flow path 84 towards the downstream end portion 56 of each fuel nozzle 20 (e.g., fuel nozzle head 59). The fuel conduit 58 may pass through a central region of the inlet plate 12. Fuel 22 enters the fuel chamber 60 of each fuel nozzle head 59, wherein the fuel is diverted into the plurality of tubes 62 to mix with compressed air 28 flowing through the inlet plate 12 and into an upstream end portion of each tube 62. In the illustrated embodiment, each tube 62 of the fuel nozzle 20 receives compressed air 28 upstream of its receipt of the fuel 22, thereby adding the fuel 22 to the flow of compressed air 28. For example, each tube 62 may receive the air 28 at an upstream end portion (e.g., upstream axial end) of the tube 62 through air inlets, whereas the tube 62 receives the fuel 22 further downstream (e.g., 5 to 50 percent of the length of the tube 62 downstream from the upstream axial end of the tube 62) through fuel inlets. Furthermore, the inlet plate 12 is configured to induce mixing in the flow of air 28 into the tubes 62 (e.g., at the upstream end portion), thereby helping to promote mixing between the air 28 and the fuel 22 within each tube 62.

The inlet plate 12 (e.g., the mix-inducing features 13) may help control the distribution of air flow into the tubes 62, the turbulence and mixing air 28 with fuel 22 within each tube 62, the ultimate fuel-air mixture 40 exiting from each tube 62, and distribution of fuel-air mixtures 40 (e.g., flow rates and fuel/air ratios) among the plurality of tubes 62 for each fuel nozzle 20. Given that the air flow 28 does not flow uniformly to each fuel nozzle 20 and each tube 62 within the head end 53, the inlet plate 12 may help condition the air flow into the fuel nozzles 20 and the tubes 62. For example, the tubes 62 near the fuel conduits 58 may receive different airflows through the tubes 62 than other tubes 62 further away from the fuel conduits 58. Likewise, the tubes 62 in the central fuel nozzle 20, 21 may receive different air flows through the tubes 62 than peripheral fuel nozzles 20 surrounding the central fuel nozzle 20, 21. Although the inlet plate 12 may be disposed at an offset distance away from the tubes 62 of the fuel nozzles 20 to provide a general flow conditioning for a shared flow into the tubes 62, a placement of the inlet plate 12 directly adjacent or affixed to the upstream axial ends of the tubes 62 may provide specific flow conditioning applicable to air flow into each individual tube 62. In other words, the inlet plate 12, directly adjacent or affixed to the upstream axial ends of the tubes 62, can independently control the fuel-air mixing within each tube 62 using the mix-inducing features 13 for each tube 62, while also helping to control the distribution or variance among all of the tubes 62. The placement and operation of the inlet plate 12 is discussed in further detail below.

Figure 3:
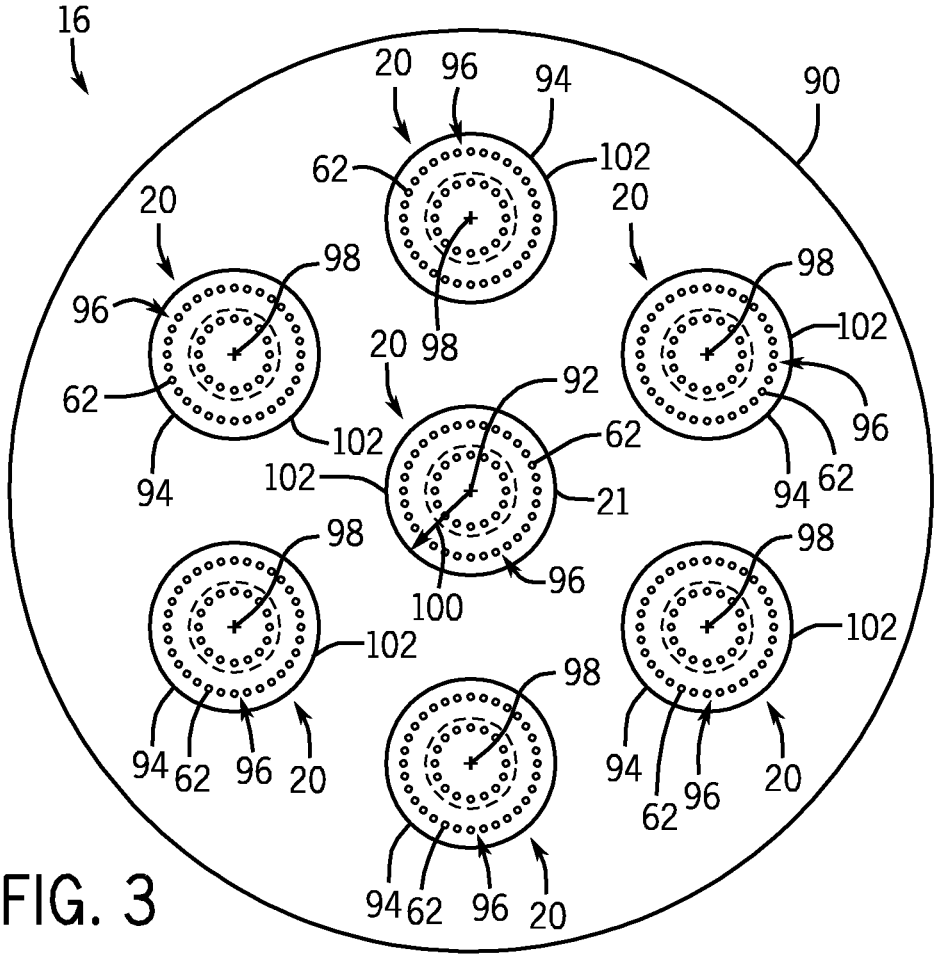
FIG. 3 is a front plan view of an embodiment of the combustor including a plurality of multi-tube fuel nozzles (e.g., circular shaped)

FIG. 3 is a front plan view of an embodiment of the combustor 16 including multiple fuel nozzles 20 (e.g., multi-tube fuel nozzles), each having an inlet plate 12 with mix-inducing features 13 for the tubes 62. The combustor 16 includes a cap member 90 supporting multiple fuel nozzles 20. As illustrated, the combustor 16 includes a fuel nozzle 20 (e.g., center fuel nozzle 21) centrally located within the cap member 90 and coaxial with the central axis 92 of the combustor 16. The combustor 16 also includes multiple fuel nozzles 20 (e.g., outer fuel nozzles 94) disposed circumferentially about the center fuel nozzle 21. As illustrated, six outer fuel nozzles 20, 94 surround the center fuel nozzle 20, 21. However, in certain embodiments, the number of fuel nozzles 20 as well as the arrangement of the fuel nozzles 20 may vary. Each fuel nozzle 20 includes the plurality of tubes 62, and thus each fuel nozzle 20 is a multi-tube fuel nozzle. As illustrated, the plurality of tubes 62 of each fuel nozzle 20 is arranged in multiple rows 96 (e.g., concentric rings of tubes 62). The rows 96 have a concentric arrangement about a central axis 98 of each fuel nozzle 20, and may extend in the radial direction 100 towards a fuel nozzle perimeter 102 (e.g., peripheral wall). In certain embodiments, the number of rows 96, number of tubes 62 per row 96, and arrangement of the plurality of tubes 62 may vary. In certain embodiments, each of the fuel nozzles 20 may include at least one of the differential configurations of inlet plates 12 discussed in detail below. In certain embodiments, only the center fuel nozzle 20, 21 may include a differential inlet plate 12. Alternatively, in certain embodiments, only the outer fuel nozzles 20, 94 may include a differential inlet plate 12. In some embodiments, both the center 21 and outer 94 fuel nozzles may include differential inlet plates 12. Furthermore, in some embodiments, each inlet plate 12 is separate from the other inlet plates 12. Alternatively, one or more nozzles 20 may have a common inlet plate 12. As discussed below, the inlet plates 12 are configured to control fuel-air mixing within each tube 62 and flow distribution among the plurality of tubes 62 of the various fuel nozzles 20.

Figure 4:
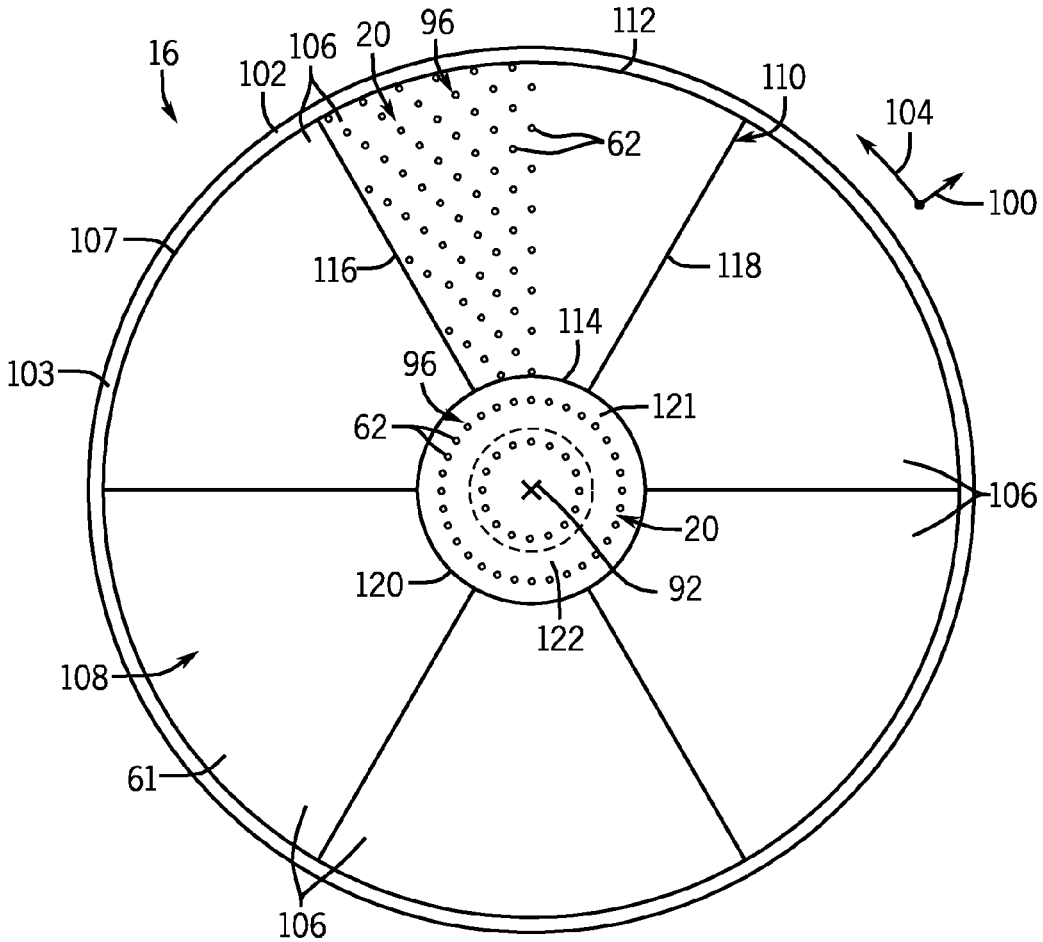
FIG. 4 is a front plan view of an embodiment of the combustor including a plurality of multi-tube fuel nozzles (e.g., truncated pie-shaped)

FIG. 4 is a front plan view of another embodiment of the combustor 16 including multiple fuel nozzles 20 (e.g., multi-tube fuel nozzles), each having an inlet plate 12 with mix-inducing features 13 for the tubes 62. The combustor 16 includes a peripheral support 103, which extends circumferentially about the fuel nozzles 20 in circumferential direction 104 about the axis 92. As illustrated, the combustor 16 includes a center fuel nozzle 20, 21 and multiple outer fuel nozzles 20, 106 disposed circumferentially 104 about the center fuel nozzle 20, 21. As illustrated, six outer fuel nozzles 106 surround the center fuel nozzle 20, 21. However, in certain embodiments, the number of fuel nozzles 20 as well as the arrangement of the fuel nozzles 20 may vary. For example, the number of outer fuel nozzles 106 may be 1 to 20, 1 to 10, or any other number. The fuel nozzles 20 are tightly disposed within the peripheral support 103. As a result, an inner perimeter 107 of the peripheral support 103 defines a circular nozzle area 108 for the combustor 16. The nozzle walls 61 of the fuel nozzles 20 encompass the entire circular nozzle area 108. Each outer fuel nozzle 106 includes a non-circular perimeter 110. As illustrated, the perimeter 110 includes a wedge shape or truncated pie shape with two generally parallel sides 112 and 114. The sides 112 and 114 are arcuate shaped, while sides 116 and 118 are linear (e.g., diverging in radial direction 100). However, in certain embodiments, the perimeter 110 of the outer fuel nozzles 106 may include other shapes, e.g., a pie shape with three sides. The perimeter 110 of each outer fuel nozzle 106 includes a region of the circular nozzle area 108. The center fuel nozzle 20, 21 includes a perimeter 120 (e.g., circular perimeter) with a perimeter row 121 of tubes 62. In certain embodiments, the perimeter 120 may include other shapes, e.g., a square, hexagon, triangle, or other polygon. The perimeter 120 of the center fuel nozzle 21 is disposed at a central portion 122 of the circular nozzle area 108 centered on the central axis 92 of the combustor 16.

Each fuel nozzle 20 (e.g., 21 and 106) includes multiple tubes 62. The tubes 62 are only shown on portions of some of the fuel nozzles 20 in FIG. 4 for clarity. As illustrated, the plurality of tubes 62 of each fuel nozzle 20 are arranged in multiple rows 96. The rows 96 of tubes 62 of the outer fuel nozzles 106 have a concentric arrangement about a central axis 92 of the combustor 16. The rows 96 of tubes 62 of the central fuel nozzle 20 21 also have a concentric arrangement about the central axis 92 of the combustor 16. In certain embodiments, the number of rows 96, number of tubes 62 per row 96, and arrangement of the plurality of tubes 62 may vary. The fuel nozzles 20 may include at least one of the differential configurations of inlet plates 12 discussed in detail below. In certain embodiments, only the center fuel nozzle 21 may include a differential inlet plate 12. Alternatively, in certain embodiments, only the outer fuel nozzles 106 may include a differential inlet plate 12. In some embodiments, both the center 21 and outer 106 fuel nozzles may include differential inlet plates 12. As discussed below, the inlet plates 12 are configured to control fuel-air mixing within each tube 62 and flow distribution among the plurality of tubes 62 of the various fuel nozzles 20.

Figure 5:
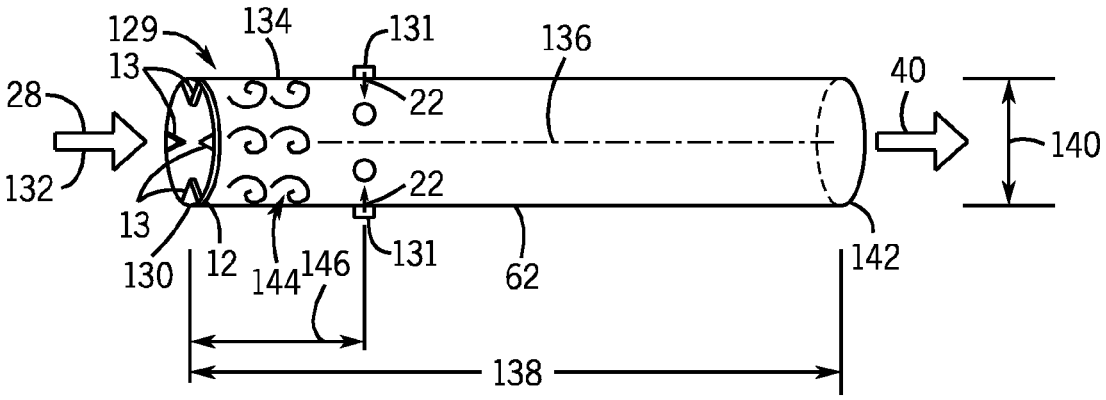
FIG. 5 is a cross-sectional view of an embodiment of a tube of a multi-tube fuel nozzle with a mix-inducing feature.

Compressed air 28 (e.g., airflow 132) may enter upstream axial inlets 130 of tubes 62 before mixing with fuel 22 in the fuel nozzles 20 discussed above. FIG. 5 is a diagram of an embodiment of one of the tubes 62 configured to mount in the fuel nozzles 20 of FIGS. 1-4, illustrating an inlet plate 12 with mix-inducing features 13 disposed at the upstream axial inlet 130 of the tube 62. The inlet plate 12 (with the mix-inducing features 13) may be dedicated to the individual tube 62, or the inlet plate 12 may be common to some or all of the plurality of tubes 62. In either configuration, the inlet plate 12 includes at least one mix-inducing feature 13 (e.g., protrusion, tab, tooth, flow disruptor, etc.) that extends crosswise into the flow path of the tube 62. In the illustrated embodiment, the inlet plate 12 includes a plurality of mix-inducing features 13 arranged about a peripheral wall 134 (e.g., annular side wall) of the tube 62, wherein the mix-inducing features 13 are disposed directly at the upstream axial inlet 130 of the tube 62. However, the mix-inducing features 13 may be disposed at any upstream portion 129 of the tube 62, such that the airflow 132 passes through the mix-inducing features 13 upstream of fuel inlets 131 for the fuel 22. As a result, the mix-inducing features 13 help promote mixing of the airflow 132 (e.g., compressed air 28) with the fuel 22 within the tube 62 before being discharged as the fuel-air mixture 40.

For purposes of discussion, without the inlet plate 12 and its associated mix-inducing features 13, the fuel-air mixing within tube 62 may be somewhat limited and based on several design parameters of the tube 62. Generally, a turbulent fluid flow may provide a greater amount of mixing than a laminar flow. For flows entering a tube 62 without the inlet plate 12, modest mixing through diffusion may occur near the peripheral wall 134 of the tube 62 due to dominant laminar flow in this region, while most mixing near the upstream axial inlet 130 may be jet-driven mixing near the center of the tube 62 (e.g., along its longitudinal axis 136) caused by the turbulence of the incoming fluid jet. Without the inlet plate 12, jet-driven mixing may be dominant for length 138 to diameter 140 (L/D) ratios between about 2 to 10; however, it may be confined to primarily a central region of the tube 62 about the longitudinal axis 136. Without the inlet plate 12, diffusion mixing and length mixing due to friction between the tube 62 and the fluid may become dominant when the L/D ratio is greater than about 10. Without the inlet plate 12, a mixing length of about 15 to 20 L/D may be used to achieve sufficient mixing by an exit 142 of the tube 62. For example, without the inlet plate 12, compressed air 28 and fuel 22 may only be partially mixed for L/D ratios less than 20, with the fuel-air mixture 40 exiting the central portion (e.g., along axis 136) being better mixed than the fuel-air mixture 40 exiting from near the peripheral wall 134. However, without the inlet plate 12, the L/D ratio may need to be even greater to ensure a desired level of mixing, so that the mixture 40 is robust enough to accommodate changes in fuel composition, temperature, and pressure. The L/D ratio of the tubes 62 may be increased by reducing the diameter 140 and/or increasing the length 138 of each tube 62, yet there are certain drawbacks reduced diameters 140 and increased lengths 138. For example, tubes 62 with small diameters 140 may have significant pressure losses due to friction, and may be unable to carry the same volume of flow as tubes 62 with larger diameters 140. Additionally, a large quantity of small diameter tubes 62 may be bulky, costly, complex to maintain or repair, and require more processing and handling than a smaller quantity of larger diameter tubes 62. Longer tubes 62 may be costly and/or occupy more linear space for sufficient mixing than what may be desired for a particular application. Accordingly, any mixing enhancements achieved by adjusting the L/D ratio may be somewhat limited and costly. Nevertheless, thoroughly mixed fuel-air mixtures 40 may enable optimal combustion within the combustor 16.

In the disclosed embodiments, the inlet plate 12 with its mix-inducing features 13 addresses the limitations of improving mixing by adjusting the foregoing parameters (e.g., L/D ratio). The mix-inducing features 13 of the inlet plate 12 are configured to disrupt the flow near the inlet 130 of the tube 62 to improve mixing and/or provide similar mixing with a shorter length 138 of the tube 62. As illustrated by the curved lines 144, the mix-inducing features 13 of the inlet plate 12 generate large scale vortices and/or small scale eddies (e.g., a turbulent or swirling flow 144) in the airflow 132 upstream of the fuel inlets 131, thereby substantially increasing the mixing of fuel 22 as it flows through the inlets 131 into the tube 62. In certain embodiments, the mix-inducing features 13 of the inlet plate 12 may be disposed at an axial offset distance 146 from the fuel inlets 131, wherein the axial offset distance 146 is approximately 0 to 75, 10 to 50, or 15 to 25 percent of the entire length 138 of the tube 62. The swirling flow 144 generated near the axial inlet 130 may disrupt all or a portion of any laminar fluid flow near the axial inlet 130, thus improving mixing throughout the tube 62. The swirling flow 144 may enhance mixing across the entire diameter 140 of the tube 62, thereby ensuring that the fuel-air mixture 40 is more uniform upon exiting the tube 62. As appreciated, the swirling flow 144 may generally be regions of rotational flow counter to the direction of flow 132 through the tube 62 from the inlet 130 to the exit 142. The swirling flow 144 is a mixing driver that supplements the jet-driven, diffusion, and length mixing discussed in detail above. Furthermore, the swirling flow 144 may be a mixing driver that is independent of the L/D ratio. For example, short tubes 62 having the swirling flow 144 generated by the mix-inducing features 13 may have better mixing quality and robustness than tubes 62 of a greater length 138 and/or a smaller diameter 140 without such additional mix-inducing features 13. Increasing the robustness of the fuel-air mixture 40 may also permit the fuel nozzles 20 to operate with different fuels 22 and to operate with improved characteristics at different temperatures and pressures. Furthermore, fuel nozzles 20 equipped with the inlet plates 12 may also operate over a wider range of fuel-air mixtures 40 with improved mixing performance.

FIGS. 6-11 are diagrams of the inlet plate 12, illustrating various embodiments of the mix-inducing features 13. As illustrated, each embodiment of the inlet plate 12 includes mix-inducing features 13 with at least one crosswise flow disturbance or flow disruptor 160. Each flow disruptor 160 is disposed in an aperture 162 of the inlet plate 12 to improve mixing in the tube 62. The aperture 162 generally aligns with the inlet axial 130 of the tube 62 (e.g., coaxial or concentric), and may have substantially the same diameter 140 as the tube 62. However, the flow disrupter 160 extends inwardly beyond the outer boundary of the peripheral wall 134 of the tube 62, e.g., in a radial direction 165 by a distance of approximately 1 to 100, 5 to 75, to 50, or 15 to 25 percent of the diameter 140 of the tube 62. The flow disruptor 160 may include any type of projection 164 of the inlet plate 12 from a perimeter 166 of the aperture 162 into the aperture 162 that may alter all or part of the airflow 132 into each tube 62. For example, the flow disruptors 160 may include wires, grids or meshes, teeth, rectangular tabs, triangular tabs, surface textures or grooves, or any combination thereof.

The flow disruptor 160 generates the swirling flow 144 (e.g., large scale vortices and/or small scale eddies) in each tube 62, thus improving the mixing in each tube 62 and/or imparting certain flow characteristics to the airflow 132. Upon passing through the inlet plate 12, the airflow 132 substantially immediately enters the tube 62 with the swirling flow 144, which then facilitates fuel-air mixing with the fuel 22 entering through the fuel inlets 131 (e.g., 1 to 100 inlets). In some embodiments, the inlet plate 12 is coupled to the plurality of tubes 62, such that the inlet plate 12 directly abuts and/or surrounds the upstream axial inlet 130 of each tube 62. For example, the inlet plate 12 may be welded, brazed, or bolted in place, such that the aperture 160 leads directly into the inlet 130 of the tube 62. In one embodiment, the inlet plate 12 includes a recessed groove 167, which receives and seals with the axial inlet 130 of each tube 62. In another embodiment, each tube 62 may be threaded into the inlet plate 12. Again, each plate 12 may include a single aperture 162 and associated projection 164 for a single tube 62, or each plate 12 may have a plurality of apertures 162 and associated projections 164 to accommodate a plurality of tubes 62.

Figure 6:
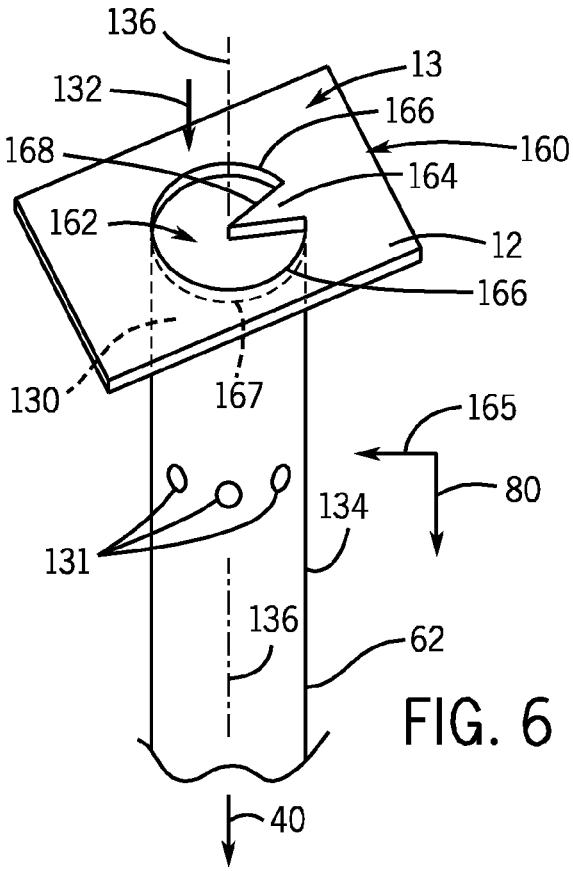
FIG. 6 is a partial perspective view of an embodiment of an inlet plate with a mix-inducing feature coupled to a tube of a multi-tube fuel nozzle.

FIG. 6 is a partial perspective view of an embodiment of the tube 62 with the inlet plate 12 having the mix-inducing feature 13 (e.g., flow disruptor 160), which includes the projection 164 shaped as a wedge or delta wing projection 168 into the aperture 162. This wedge 168 may generate the swirling flow 144 in the airflow 132 entering into the tube 62 at the axial inlet 130. The single wedge 168 may affect the mixing within a local region or the entire tube 62, while obstructing only a portion of the airflow 132 through the aperture 162. Downstream of the mix inducing feature 13, fuel inlets 131 may extend through the perimeter 134 of the tube 62 and inject fuel 22 into the airflow 132. In another embodiment, the flow disruptor 160 may include multiple wedges 168 that project into the aperture 162 as illustrated in FIG. 7.

Figure 7:
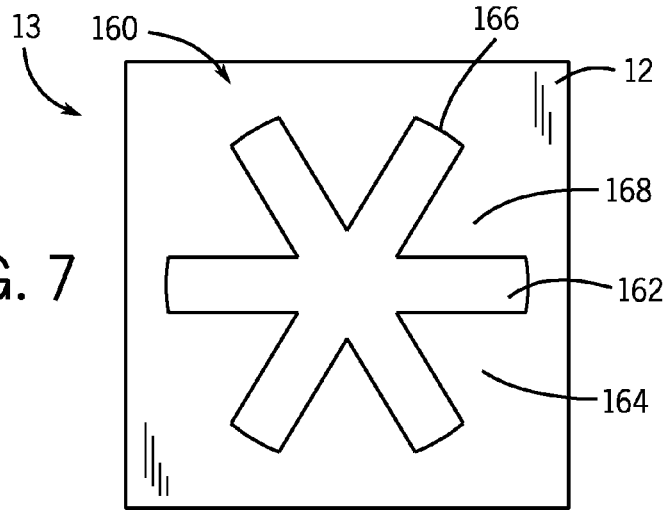
FIG. 7 is a front view of an embodiment of an mix-inducing feature.

FIG. 7 is a front view of an embodiment of the inlet plate 12 having the mix-inducing feature 13 (e.g., flow disruptor 160), which includes a plurality of projections 164 shaped as a wedge or delta wing projections 168 spaced about the axis 136 of the aperture 162 and tube 62. Multiple wedges 168 may improve the mixing within the tube 62 by inducing more swirling flow 144 than a single wedge 168. In this embodiment, each wedge 168 may extend in the radial direction 165 inward toward the axis 136 by a radial distance of approximately 5 to 40 or 10 to 25 percent of the diameter 140 of the tube 62.

Figure 8:
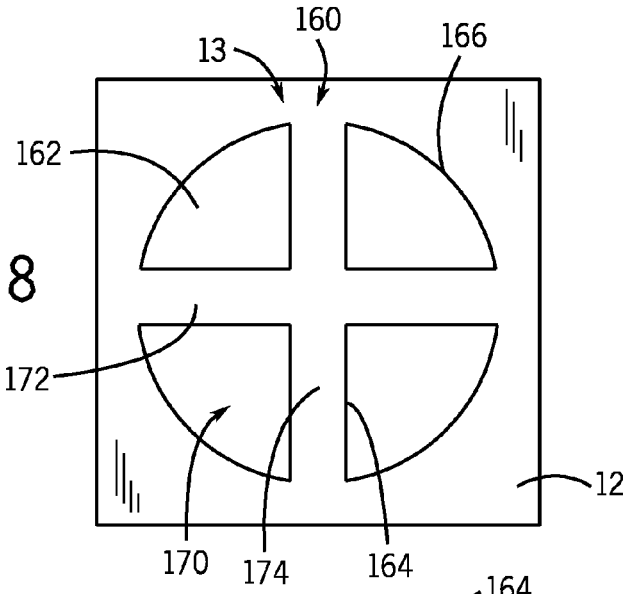
FIG. 8 is a front view of an embodiment of a mix-inducing feature.

FIG. 8 is a front view of an embodiment of the inlet plate 12 having the mix-inducing feature 13 (e.g., flow disruptor 160), which includes a plurality of projections 164 (e.g., four projections) that converge to the axis 136 of the aperture 162 and tube 62. In other words, the projections 164 may extend crosswise to one another, while also intersecting one another to define a grid or mesh 170. For example, the mesh 170 may include a first crosswise member 172 and a second crosswise member 174, which cross one another in a perpendicular or other crosswise relationship to define an "X" shaped mesh 170 or a "+" shaped mesh. In this manner, the mesh 170 defines four sectors or quadrants of the aperture 162, wherein the quadrants are divided by the members 172 and 174.

Figure 9:
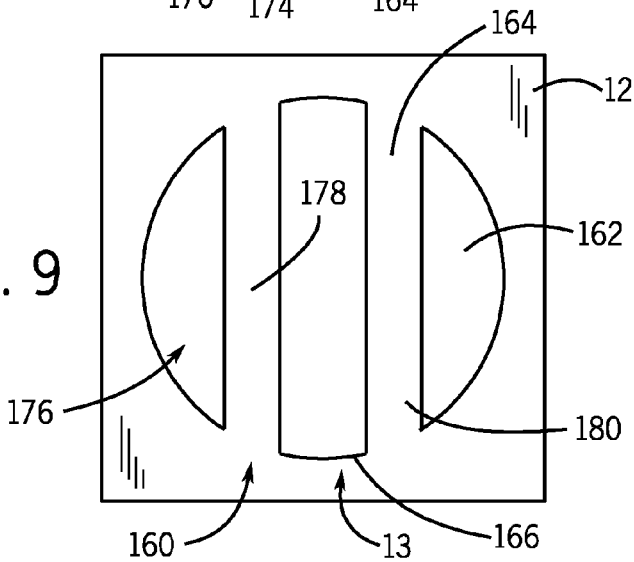
FIG. 9 is a front view of an embodiment of a mix-inducing feature.

FIG. 9 is a front view of an embodiment of the inlet plate 12 having the mix-inducing feature 13 (e.g., flow disruptor 160), which includes a plurality of projections 164 (e.g., two projections 178 and 180) that are generally parallel to one another across the aperture 162 and tube 62. In other words, the projections 164 may define a grill 176. For example, the grill 176 may include a first parallel member 178 and a second parallel member 180, which divide the aperture 162 into multiple parallel sectors (e.g., three sectors). In other embodiments, any number of parallel members (e.g., 1, 2, 3, 4, 5, 6, 7, 8, 9, 10, or more) may be disposed across the aperture 162 in a parallel arrangement. In other embodiments, projections 164 may divide the aperture 162 into multiple non-parallel sectors.

Figure 10:
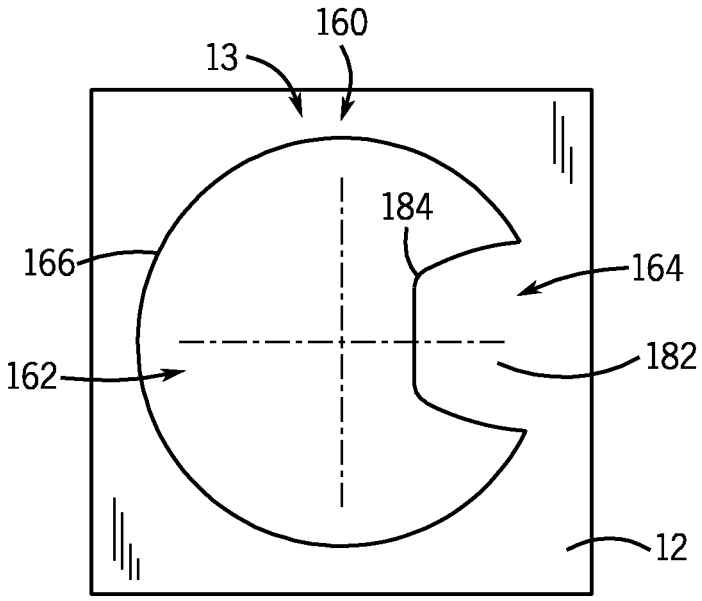
FIGS. 10 and 11 are top and side views of an embodiment of a mix-inducing feature with a bent portion.
Figure 11:
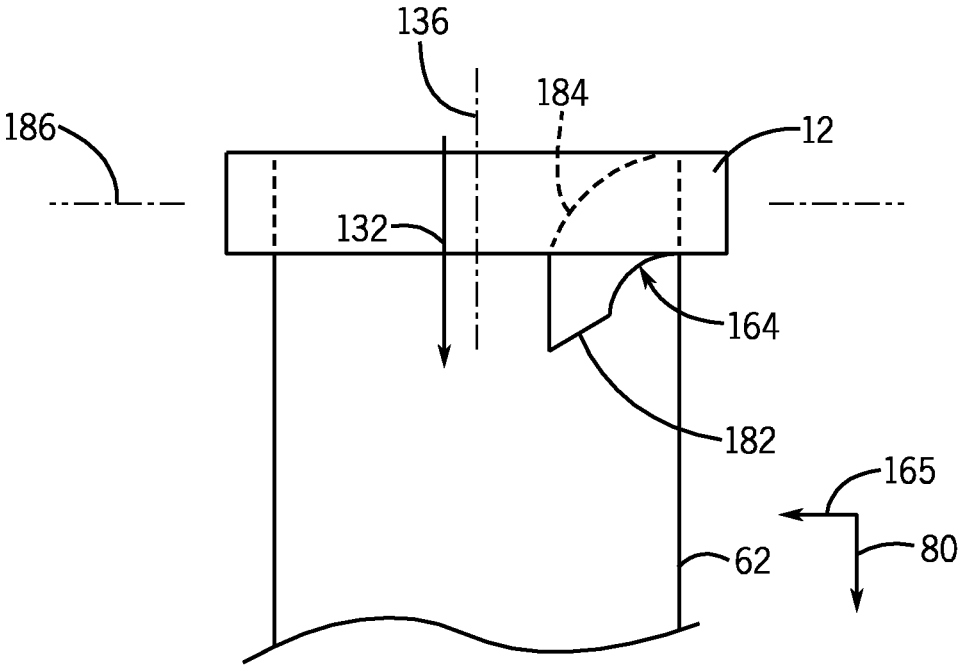

FIGS. 10 and 11 are top and side views of another embodiment of the inlet plate 12 having the mix-inducing feature 13 (e.g., flow disruptor 160), which includes a projection 164 that extends both in the radial direction 165 and the axial direction 80 into the tube 62. Similar to the embodiment of FIG. 6, the projection 164 of FIGS. 10 and 11 is a single wedge-shaped projection 182, which also includes a bent or angled portion 184. The angled portion 184 of FIG. 11 is angled or bent in the downstream axial direction 80 away from a plane 186 of the plate 12, although other embodiments of the angled portion 184 may be angled or bent in an upstream axial direction 186 away from the plane 186 of the plate 12. This angled portion may be applicable to any of the embodiments presented above with reference to FIGS. 1-9 as well. For example, each of the mix-inducing features 13 (e.g., flow disruptors 160) of FIGS. 5-9 may include an upwardly angled portion and/or a downwardly angled portion to enhance mixing at the inlet 130.

In certain embodiments, the mix-inducing features 13 (e.g., flow disruptors 160) may be integrally formed with (e.g., one-piece) with the inlet plate 12, while other embodiments of the mix-inducing features 13 (e.g., flow disruptors 160) may be separate from but attached to the inlet plate 12. In a one-piece construction of the plate 12, the mix-inducing features 13 (e.g., flow disruptors 160) may be formed by punching, casting, machining, or otherwise removing at least some material from the plate 12 to form the apertures 162, while retaining at least some material in the apertures 162 to define the projections 164. In some embodiments, direct metal laser sintering (DMLS) or other additive fabrication techniques may be employed to form the inlet plate 12 with the flow disruptor 160. Furthermore, the angled portions 184 of projections 164 may be simultaneously or separately formed on the plate 12. For example, a single punching operation may simultaneously create the apertures 162, the projections 164, and the angled portions 184 of the projections 164. However, any suitable technique may be used to create the projections 164. In other embodiments, the projections may be attached to the plate 12 via welding, brazing, bolts, or other fasteners. In addition, the inlet plate 12 may be coupled to the flow sleeve 50, fuel conduits 58, or fuel nozzles 20.

In some embodiments, each aperture 162 of the inlet plate 12 may correspond to a tube 62. In an embodiment, each aperture 162 is concentric with a corresponding tube 62 of the tube bundle 82. In this embodiment with an inlet plate 12 having apertures 162 concentric to tube 62, the flow disruptor 160 may alter the airflow 132 entering each tube 62. Alternatively, each aperture 162 of the inlet plate 12 may not be concentric with each respective tube 62 of the tube bundle 82, but rather the perimeter 166 of each aperture 162 may partially extend over the axial inlet 130 of each tube 62. For example, each tube axis 136 may be offset from the aperture axis, causing the perimeter 166 to extend over the axial inlet 130. This configuration of the inlet plate 12 may cause both the flow disruptor 160 of each aperture 162 and the perimeter 166 extending over the axial inlet 130 to alter the airflow 132 entering the tube 62.

Figure 12:
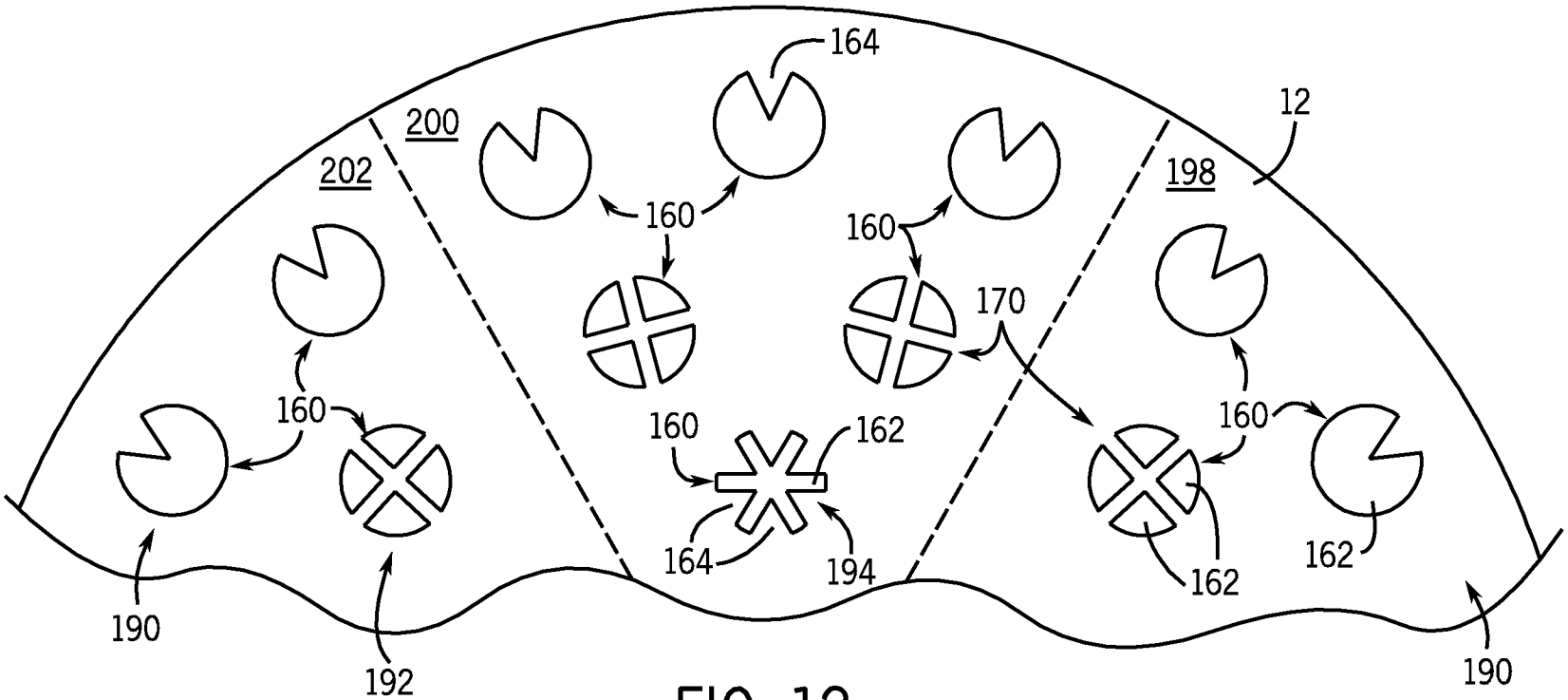
FIG. 12 is a front view of an embodiment of an inlet plate with a differential configuration of mix inducing features.

Differential configurations of inlet plates 12 may be utilized to create different qualities of fuel-air mixtures 40 for different fuel nozzles 20. FIG. 12 illustrates an embodiment of portion an inlet plate 12 with a plurality of apertures 162 with a differential configuration of inlet features (e.g., flow disruptors 160) among the plurality of tubes 62 downstream of the inlet plate. In an embodiment, each aperture 162 of a first row 190 may have a single projection 164 into the aperture 162 (e.g., FIG. 6), each aperture 162 of a second row 192 may have a mesh 170 across the aperture 162 (e.g., FIG. 8), and each aperture 162 of a third row 194 may have a plurality of wedge shape projections 182 spaced about the aperture 162 (e.g., FIG. 7). The differential configuration of flow disruptors 160 across the inlet plate 12 is not limited to rows (e.g., 190, 192, and 194) of apertures 162. For example, the apertures 162 of a first section 198 of an inlet plate 12 may have a first flow disruptor 160, the apertures 162 of a second section 200 may have a second flow disruptor 160, and the apertures 162 of a third section 202 may have a third flow disruptor 160. The orientation of the same flow disruptors 160 may also differ across the inlet plate 12.

Some flow disruptors 160 may improve mixing within the tubes 62 more than others. In some embodiments, the flow disruptor 160 may be selectively placed to generate specific fuel-air mixtures 40 for each nozzle 20. Some flow disruptors 160 may provide specific airflow characteristics (e.g., swirl direction, rapid mixing) to the fuel-air mixture 40 that cause the injected fuel-air mixture 40 to be more robust for certain conditions. In some embodiments, inlet plates 12 with specific flow disruptors 160 may be disposed at the inlets of certain tubes 62 that inject the fuel-air mixture 40 into regions of the combustion chamber 68 that exhibit such conditions. For example, if the region of the combustion chamber 68 adjacent the center fuel nozzle 21 exhibits recirculation and the wedge shape projection 182 with the angled portion 184 generates swirl in the fuel-air mixture 40 that reduces recirculation, then the apertures 162 of the inlet plate 12 for the center fuel 21 may include the wedge shape projection 182 with the angled portion 184.

In other embodiments, each aperture 162 may include a different type of flow disruptor 160 for each tube 62 based on the location of the tube 62 within the fuel nozzle 20 and/or the combustor 16. Thus, each fuel nozzle 20 may include any number (e.g., 1 to 100 or more) of different types of flow disruptors 164 to control an overall flow distribution and fuel-air mixing among the plurality of tubes 62. As noted above, mixing within a tube 62 may be affected by the location of the tube 62 within the fuel nozzle 20. For example, jet-driven mixing may be more dominant in the inlet of tubes 62 near the central axis 98 of each nozzle 20 as compared with tubes 62 near the perimeter 102 of the nozzle 20. This may lead to less thoroughly mixed fuel-air mixtures 40. Likewise, jet-driven mixing may be more dominant in the tubes 62 near the central axis 92 of the combustor 16 as compared with tubes 62 near the perimeter of the combustor 16. The aperture 162 for each tube 62 exhibiting this characteristic may include a particular flow disruptor 160 to counter this characteristic and improve the mixing for the respective tube 62 by creating turbulence within the tube 62.

Although specific embodiments of the mix-inducing features 13 (e.g., flow disruptors 160) have been illustrated and described with reference to FIGS. 1-10, the flow disruptors 160 may include any type, shape, or pattern of projections 164 into the aperture 162, including rotationally symmetric (e.g., FIG. 7) and asymmetric projections (e.g., FIG. 6), regular and irregular shapes, mixing features that intersect other mixing features (e.g., FIG. 9), and mixing features that cross all or part of the aperture 162 (e.g., FIGS. 9 and 10).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method, comprising:

receiving air into a plurality of tubes extending through a body of a multi-tube fuel nozzle, wherein each tube of the plurality of tubes intakes the air through an aperture of a plurality of apertures having at least one mix-inducing feature that extends crosswise to the aperture at an upstream axial end of the respective tube, wherein the plurality of apertures associated with the plurality of tubes are disposed on at least one inlet plate disposed in contact with the plurality of tubes, wherein a first tube of the plurality of tubes has a first aperture with a first mix-inducing feature comprising a first size and a first shape, wherein a second tube of the plurality of tubes has a second aperture with a second mix-inducing feature comprising a second size and a second shape, wherein the first and second mix-inducing features are geometrically different from one another in that the first size is different than the second size, or the first shape is different than the second shape, or any combination thereof;

receiving fuel into each tube of the plurality of tubes at a downstream position from the upstream axial end of the tube; and outputting a fuel-air mixture from the plurality of tubes.

2. A system comprising:

a multi-tube fuel nozzle, comprising:

an inlet plate comprising a plurality of apertures and a plurality of mix-inducing features, wherein each aperture comprises at least one mix-inducing feature of the plurality of mix-inducing features, and the at least one mix-inducing feature of the plurality of mix-inducing features comprises a projection extending crosswise into the aperture; and a plurality of tubes coupled to and in contact with the inlet plate, wherein each tube of the plurality of tubes comprises a fuel inlet at a downstream position relative to the inlet plate, each tube of the plurality of tubes is aligned with the respective aperture of the plurality of apertures, and the plurality of mix-inducing features are geometrically different from one another in a size, or a shape, or any combination thereof.

3. The system of claim 2, wherein each tube of the plurality of tubes is configured to receive an airflow through the respective aperture.

4. The system of claim 2, wherein the plurality of mix-inducing features comprises at least two projections selected from a wedge-shaped protrusion, a grid of members that extend crosswise to one another across the respective aperture of the plurality of apertures, a grill of members that extend parallel to one another across the respective aperture of the plurality of apertures, and a plurality of protrusions that are symmetrically arranged about an axis of the respective aperture.

5. The system of claim 2, wherein each mix-inducing feature of the plurality of mix-inducing features is geometrically different based at least in part on a location of the respective aperture of the plurality of apertures in the multi-tube fuel nozzle.

6. The system of claim 2, wherein the projection of the respective aperture is angled in an upstream direction or a downstream direction of flow through the respective aperture.

7. The system of claim 2, wherein the projection of the respective aperture comprises a single wedge shaped protrusion.

8. The system of claim 2, wherein the projection of the respective aperture comprises a grid of members that extend crosswise to one another across the respective aperture.

9. The system of claim 2, wherein the projection of the respective aperture comprises a grill of members that extend parallel to one another across the respective aperture.

10. The system of claim 2, wherein the mix-inducing feature of the respective aperture comprises a plurality of protrusions that are symmetrically arranged about an axis of the respective aperture.

11. The system of claim 2, comprising a plurality of multi-tube fuel nozzles that share the inlet plate.

12. The system of claim 2, comprising a turbine combustor or a turbine engine having the multi-tube fuel nozzle.

13. The system of claim 2, wherein each tube of the plurality of tubes comprises a length to diameter (L/D) ratio less than 20.

14. The system of claim 2, wherein the plurality of mix-inducing features comprises at least one projection that extends only partially across the respective aperture of the plurality of apertures.

15. A system comprising:

a fuel nozzle inlet plate configured to couple with and contact a plurality of tubes of a multi-tube fuel nozzle, wherein the fuel nozzle inlet plate is shared among the plurality of tubes of the multi-tube fuel nozzle, and the fuel nozzle inlet plate comprises:

a plurality of apertures, wherein each aperture of the plurality of apertures is configured to align with an upstream axial inlet of a respective tube of the plurality of tubes; and a plurality of mix-inducing features, wherein each mix-inducing feature of the plurality of mix-inducing features is disposed in a respective aperture of the plurality of apertures, each mix-inducing feature of the plurality of mix-inducing features comprises at least one projection extending crosswise into the respective aperture of the plurality of apertures, each mix-inducing feature of the plurality of mix-inducing features is geometrically different from another mix-inducing feature based at least in part on a location of the respective aperture of the plurality of apertures in the fuel nozzle inlet plate, the geometric differences among the plurality of mix-inducing features comprise differences in a size, or a shape, or any combination thereof, and each mix-inducing feature of the plurality of mix-inducing features is configured to mix an air flow passing through the respective aperture of the plurality of apertures into the respective tube of the plurality of tubes and a fuel flow entering the respective tube through a fuel inlet downstream of the upstream axial inlet of the respective tube.

16. The system of claim 15, wherein at least one of the plurality of mix-inducing features comprises at least one projection that extends only partially across the respective aperture of the plurality of apertures.

17. The system of claim 15, wherein at least one of the plurality of mix-inducing features comprises at least one projection that extends completely across the respective aperture of the plurality of apertures.

18. The system of claim 15, comprising the multi-tube fuel nozzle having the fuel nozzle inlet plate.

19. The system of claim 15, wherein the plurality of mix-inducing features comprises a grid of members that extend crosswise to one another across the respective aperture of the plurality of apertures, a grill of members that extend parallel to one another across the respective aperture of the plurality of apertures, a plurality of protrusions that are symmetrically arranged about an axis of the respective aperture of the plurality of apertures, a single wedge shaped protrusion, or at least one projection that is angled in an upstream direction or a downstream direction of the air flow through the respective aperture of the plurality of apertures, or any combination thereof.

* * * * *